US005912222A

United States Patent [19]

Thomas et al.

[11] Patent Number: 5,912,222

[45] **Date of Patent: *Jun. 15, 1999**

[54] MICROEMULSION LIGHT DUTY LIQUID CLEANING COMPOSITIONS

[75] Inventors: Barbara Thomas, Princeton; Ammanuel Mehreteab, Piscataway; Gilbert Gomes, Somerset; Frank Bala, Jr., Middlesex; Jiashi Tarng, Dayton, all of N.J.

[73] Assignee: Colgate Palmolive Company, New York, N.Y.

[ * ] Notice: This patent is subject to a terminal disclaimer.

[21] Appl. No.: 08/924,561

[22] Filed: Sep. 5, 1997

Related U.S. Application Data

[63] Continuation-in-part of application No. 08/620,660, Mar. 18, 1996, abandoned, which is a continuation-in-part of application No. 08/296,386, Aug. 26, 1994, abandoned.

[51] Int. Cl.[6] ..... C11D 1/831; C11D 1/84

[52] U.S. Cl. ..... 510/417; 252/311; 510/429; 510/470; 510/472; 510/506; 510/365

[58] Field of Search ..... 510/365, 417, 510/428, 429, 470, 495, 472, 506; 252/311

[56] References Cited

U.S. PATENT DOCUMENTS

| | | | |
|---|---|---|---|
| 3,332,876 | 7/1967 | Walker | 252/152 |
| 5,415,813 | 5/1995 | Misselyn et al. | 252/547 |
| 5,531,938 | 7/1996 | Erilli . | |
| 5,604,195 | 2/1997 | Misselyn et al. | 510/400 |
| 5,714,454 | 2/1998 | Thomas | 510/426 |
| 5,741,769 | 4/1998 | Erilli | 510/417 |

*Primary Examiner*—Margaret Einsmann
*Attorney, Agent, or Firm*—Richard Nanfeldt

[57] ABSTRACT

A liquid duty liquid microemulsion composition comprises a mixture of a magnesium salt of a sulfonate surfactant, an alkyl ether polyethenoxy sulfate, a biodegradable surfactant, a cosurfactant, a perfume or water insoluble hydrocarbon and water.

11 Claims, No Drawings

MICROEMULSION LIGHT DUTY LIQUID CLEANING COMPOSITIONS

RELATED APPLICATION

This application is a continuation in part application of U.S. Ser. No. 8/620,660filed Mar. 18, 1996 abandoned which in turn is a continuation in part application of U.S. Ser. No. 8/296,386 filed Aug. 26, 1994 abandoned.

FIELD OF THE INVENTION

This invention relates to an improved light duty liquid cleaner in the form of a microemulsion designed in particular for cleaning hard surfaces and which is effective in removing grease soil and/or kitchen soil and in leaving unrinsed surfaces with a shiny appearance.

BACKGROUND OF THE INVENTION

In recent years liquid detergents have become widely accepted for cleaning hard surfaces, e.g., painted woodwork and panels, tiled walls, wash bowls, bathtubs, linoleum or tile floors, washable wall paper, etc.. Such liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surface liquid detergent compositions where product homogeneity and clarity are important considerations involves the formation of oil-in-water (o/w) microemulsions which contain one or more surface active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of about 25 to about 800 Å in a continuous aqueous phase. In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbots et al; European Patent Application EP 0160762—Johnston et al; and U.S. Pat. No. 4,561,991—Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to about 18% by weight of the aqueous phase), the presence of such high quantities of grease-removal solvent tend to reduce the total amount of greasy or oily soils which can be taken up by and into the microemulsion without causing phase separation. The following representative prior art patents also relate to liquid detergent cleaning compositions in the form of o/w microemulsions: U.S. Pat. Nos.. 4,472,291—Rosario; 4,540,448—Gauteer et al; 3,723,330—Sheflin.

Liquid detergent compositions which include terpenes, such as d-limonene, or other grease-removal solvent, although not disclosed to be in the form of o/w microemulsions, are the subject matter of the following representative patent documents: European Patent Application 0080749; British Patent Specification 1,603,047; 4,414,128; and 4,540,505. For example, U.S. Pat. No. 4,414,128 broadly discloses an aqueous liquid detergent composition characterized by, by weight:

(a) from about 1% to about 20% of a synthetic anionic, nonionic, amphoteric or zwitterionic surfactant or mixture thereof;

(b) from about 0.5% to about 10% of a mono- or sesquiterpene or mixture thereof, at a weight ratio of (a):(b) lying in the range of 5:1 to 1:3; and (c) from about 0.5% about 10% of a polar solvent having a solubility in water at 15° C. in the range of from about 0.2% to about 10%. Other ingredients present in the formulations disclosed in this patent include from about 0.05% to about 2% by weight of an alkali metal, ammonium or alkanolammonium soap of a $C_{13}$–$C_{24}$ fatty acid; a calcium sequestrant from about 0.5% to about 13% by weight; non-aqueous solvent, e.g., alcohols and glycol ethers, up to about 10% by weight; and hydrotropes, e.g., urea, ethanolamines, salts of lower alkylaryl sulfonates, up to about 10% by weight. All of the formulations shown in the Examples of this patent include relatively large amounts of detergent builder salts which are detrimental to surface shine.

Furthermore, the present inventors have observed that in formulations containing grease-removal assisting magnesium compounds, the addition of minor amounts of builder salts, such as alkali metal polyphosphates, alkali metal carbonates, nitrilotriacetic acid salts, and so on, tends to make it more difficult to form stable microemulsion systems.

SUMMARY OF THE INVENTION

The present invention provides an improved, clear light duty liquid cleaning composition having improved interfacial tension which improves cleaning hard surface in the form of a microemulsion which is suitable for cleaning hard surfaces such as dishes, plastic, vitreous and metal surfaces having a shiny finish. The light duty liquid microemulsion compositions of the instant invention can be generally described as comprising approximately by weight:

(a) 15% to 36%, preferably 18% to 34%, of a mixture of a magnesium metal salt of a $C_{13}$–$C_{17}$ alkyl sulfonate surfactant;

(b) 1% to 20%, more preferably 2% to 18% of an alkali metal salt or ammonium salt of a $C_8$–$C_{18}$ alkyl polyethenoxy sulfate surfactant, wherein the ratio of sulfonate surfactant to the sulfate surfactant is about 8:1 to about 1:8, more preferably about 7:1 to about 1:2;

(c) 0.5% to about 10%; more preferably 1% to 5% of an alkyl polyglucoside surfactant;

(d) 0.4% to 10.0%, more preferably 2.0% to 7.0% of a perfume, an essential oil or a water insoluble hydrocarbon;

(e) 1% to 25%, more preferably 2 to 8% of a cosurfactant;

(f) 0 to 5%, more preferably 0.1 to 3% of at least one hydrotrope;

(g) 0 to 4%; more preferably 0.1 to 2% of magnesium sulfate;

(h) 0.5% to 5%, more preferably 0.5 to 3% of an alkyl monoalkanol amide and/or an alkyl dialkanol amide and mixtures thereof; and (i) the balance being water, wherein the composition has a Brookfield viscosity at 25°C. at 3 rpms using a #18 spindle spindle of about 20 to 500 cps, more preferably about 100 to 450 cps, a pH of about 5 to about 7, and a light transmission of at least about 95%, more preferably at least about 98%. Explicitly excluded from the instant compositions are nonionic surfactants which are the condensation product of an organic aliphatic or alkyl aromatic hydrophobic compound and hydrophilic ethylene oxide and/or propylene oxide groups, zwitterionic surfactant such as a betaine surfactant straight chain $C_{12-16}$ mono olefin sulfonate surfactants, cationic surfactants and grease release agents consisting of

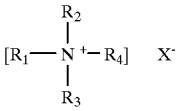

wherein $R_1$ is a methyl group and $R_2$, $R_3$ and $R_4$ are independently selected from the group consisting of $CH_3$, $C_2H_5$, $CH_2CH_2Y$, wherein Y is selected from the group consisting of Cl, Br, $CO_2H_1$, $(CH_2O)_nOH$, wherein n is 1 to 10 and OH and X is selected from the group consisting of Cl, Br, methosulfate and $HCO_3$ such as choline chloride. The weight ratio of the magnesium salt of the $C_{10-16}$ linear alkyl benzene sulfonate surfactant to the alkyl polyglucoside surfactant is at least 12:1 preferably 15:1 and the weight ratio of the magnesium salt of the $C_{10-16}$ linear alkyl benzene sulfonate surfactant plus the metal or ammonium salt of the alkyl ether polyethenoxy sulfate surfactant to the alkyl polyglucoside surfactant is at least 15:1 and more preferably 18:1.

DETAILED DESCRIPTION OF THE INVENTION

The present invention relates to a stable microemulsion composition approximately by weight: about 0.5% to about 10% of an alkyl polyglucoside surfactant, 15% to 36% of a sulfonate anionic surfactant, 1% to 20% of an alkyl ether polyethenoxysulfate surfactant. 1% to 25% of a cosurfactant, 0.4% to 10% of a water insoluble hydrocarbon, essential oil or a perfume, 0 to 5% of at least one hydrotrope, 0 to 4% of magnesium sulfate, 0.5% to 5% of an alkyl monoalkanolamide and/or an alkyl dialkanol amide and the balance being water, said composition having a light transmission of at least about 95%, more preferably at least about 98%. Explicitly excluded from the instant compositions are nonionic surfactants which are the condensation product of an organic aliphatic or alkyl aromatic hydrophobic compound and hydrophilic ethylene oxide and/or propylene oxide groups, zwitterionic surfactant such as a betaine surfactant straight chain $C_{12-16}$ mono olefin sulfonate surfactants, cationic surfactants and grease release agents consisting of

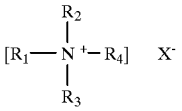

wherein $R_1$ is a methyl group and $R_2$, $R_3$ and $R_4$ are independently selected from the group consisting of $CH_3$, $C_2H_5$, $CH_2CH_2Y$, wherein Y is selected from the group consisting of Cl, Br, $CO_2H_1$, $(CH_2O)_nOH$, wherein n is 1 to 10 and OH and X is selected from the group consisting of Cl, Br, methosulfate and $HCO_3$ such as choline chloride. The weight ratio of the magnesium salt of the $C_{10-16}$ linear alkyl benzene sulfonate surfactant to the alkyl polyglucoside surfactant is at least 12:1 preferably 15:1 and the weight ratio of the magnesium salt of the $C_{10-16}$ linear alkyl benzene sulfonate surfactant plus the metal or ammonium salt of the alkyl ether polyethenoxy sulfate surfactant to the alkyl polyglucoside surfactant is at least 15:1 and more preferably 18:1.

According to the present invention, the role of the hydrocarbon is provided by a water insoluble perfume. Typically, in aqueous based compositions the presence of a solubilizers, such as alkali metal lower alkyl aryl sulfonate hydrotrope, triethanolamine, urea, etc., is required for perfume dissolution, especially at perfume levels of about 1% and higher, since perfumes are generally a mixture of fragrant essential oils and aromatic compounds which are generally not water-soluble. Therefore, by incorporating the perfume into the aqueous cleaning composition as the oil (hydrocarbon) phase of the ultimate o/w microemulsion composition, several different important advantages are achieved.

First, the cosmetic properties of the ultimate cleaning composition are improved: the compositions are both clear (as a consequence of the formation of a microemulsion) and highly fragranced (as a consequence of the perfume level).

Second, the need for use of solubilizers, which do not contribute to cleaning performance, is eliminated.

As used herein and in the appended claims the term "perfume" is used in its ordinary sense to refer to and include any water insoluble fragrant substance or mixture of substances including natural (i.e., obtained by extraction of flower, herb, blossom or plant), artificial (i.e., mixture of natural oils or oil constituents and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from about 0% to about 80%, usually from about 100% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

The hydrocarbon such as a perfume is present in the dilute o/w microemulsion in an amount of from about 0.4% to about 10% by weight, preferably from about 1.0% to about 8.0% by weight, especially preferably from about 2% to about 7% by weight. If the amount of hydrocarbon (perfume) is less than about 0.4% by weight it becomes difficult to form the o/w microemulsion. If the hydrocarbon (perfume) is added in amounts more than about 10% by weight, the cost is increased without any additional cleaning benefit and, in fact, with some diminishing of cleaning performance insofar as the total amount of greasy or oily soil which can be taken up in the oil phase of the microemulsion will decrease proportionately.

Furthermore, although superior grease removal performance will be achieved for perfume compositions not containing any terpene solvents, it is apparently difficult for perfumers to formulate sufficiently inexpensive perfume compositions for products of this type (i.e., very cost sensitive consumer-type products) which include less than about 20%, usually less than about 30%, of such terpene solvents.

Thus, merely as a practical matter, based on economic consideration, the dilute o/w microemulsion detergent cleaning compositions of the present invention may often include as much as about 0.2% to about 7% by weight, based on the total composition, of terpene solvents introduced thereunto via the perfume component. However, even when the amount of terpene solvent in the cleaning formulation is less than 1.5% by weight, such as up to about 0.6% by weight or 0.4% by weight or less, satisfactory grease removal and oil removal capacity is provided by the inventive diluted o/w microemulsions.

In place of the perfume one can employ an essential oil such as D-limonene or alpha-terpineol, a water insoluble paraffin or isoparaffin having about 6 to about 18 carbon at a concentration of about 0.4 to about 10.0 wt. percent, more preferably 2.0 to 7.0 wt. %.

Suitable water-soluble non-soap, anionic detergents include those surface-active or detergent compounds which contain an organic hydrophobic group containing generally 8 to 26 carbon atoms and preferably 10 to 18 carbon atoms in their molecular structure and at least one water-solubilizing group selected from the group of sulfonate, sulfate and carboxylate so as to form a water-soluble detergent. Usually, the hydrophobic group will include or comprise a $C_8$–$C_{22}$ alkyl, alkylaryl or acyl group. Such detergents are employed in the form of magnesium salts. Examples of suitable sulfonated anionic detergents are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

A preferred sulfonate is linear alkyl benzene sulfonate having a high content of 3-(or higher) phenyl isomers and a correspondingly low content (well below 50%) of 2-(or lower) phenyl isomers, that is, wherein the benzene ring is perferably attached in large part at the 3 or higher (for example, 4, 5, 6 or 7) position of the alkyl the content of the isomers in which the benzene ring is attached in the 2 or 1 position is correspondingly low. Particularly preferred materials are set forth in U.S. Pat. No. 3,320,174.

Other examples of suitable anionic sulfonate detergents are the paraffin sulfonates containing about 10 to 20, preferably about 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735,096.

Generally, the proportion of the nonsoap-anionic sulfonate detergent will be in the range of 15% to 36%, preferably from 18% to 34%, by weight of the dilute o/w microemulsion composition.

Examples of satisfactory anionic sulfate detergents are the $C_8$–$C_{18}$ alkyl ether polyethenoxy sulfate salts having the formula $R(OC_2H_4)_n\ OSO_3M$ wherein n is 1 to 12, preferably 1 to 5, and M is a solubilizing cation selected from the group consisting of alkali metal cations such as sodium or potassium, alkaline earth metal cations such as magnesium, ammonium, and mono-, di- and triethanol ammonium ions, wherein sodium, potassium and ammonium are preferred. The alkyl ether polyethenoxy sulfates are obtained by sulfating the condensation product of ethylene oxide with a $C_8$–$C_{18}$ alkanol and neutralizing the resultant product. The alkyl ether polyethenoxy sulfates differ from one another in the number of moles of ethylene oxide reacted with one mole of alkanol. Preferred alkyl ether polyethenoxy sulfates contain 10 to 16 carbon atoms in the alkyl group.

The $C_8$–$C_{12}$ alkylphenyl ether polyethenoxy sulfates containing from 2 to 6 moles of ethylene oxide in the molecule also are suitable for use in the inventive compositions. These detergents can be prepared by reacting an alkyl phenol with 2 to 6 moles of ethylene oxide and sulfating and neutralizing the resultant ethoxylated alkylphenol.

Of the foregoing non-soap anionic detergents, the preferred detergents are the $C_9$–$C_{15}$ linear alkylbenzene sulfonates and the $C_{13}$–$C_{17}$ paraffin or alkane sulfonates. Particularly, preferred compounds are magnesium $C_{10}$–$C_{13}$ alkylbenzene sulfonate and magnesium $C_{13}$–$C_{17}$ alkane sulfonate.

Generally, the proportion of the nonsoap-anionic alkyl ether polyethenoxy sulfate detergent will be in range 1% to 20%, preferably 2% to 18% by weight of the dilute o/w microemulsion composition, wherein the ratio of paraffin sulfonate to the alkyl ether polyethenoxy sulfate is about 8:1 to about 1:8, more preferably about 7:1 to about 1:2.

The cosurfactant may play an essential role in the formation of the microemulsion compositions. Very briefly, in the absence of the cosurfactant the water, detergent(s) and hydrocarbon (e.g., perfume) will, when mixed in appropriate proportions to form either a micellar solution (low concentration) or form an oil-in-water emulsion. With the cosurfactant added to this system, the interfacial tension at the interface between the emulsion droplets and aqueous phase is reduced to a very low value. This reduction of the interfacial tension results in spontaneous break-up of the emulsion droplets to consecutively smaller aggregates until the state of a transparent colloidal sized emulsion. e.g., a microemulsion, is formed. In the state of a microemulsion, thermodynamic factors come into balance with varying degrees of stability related to the total free energy of the microemulsion. Some of the thermodynamic factors involved in determining the total free energy of the system are (1) particle-particle potential; (2) interfacial tension or free energy (stretching and bending); (3) droplet dispersion entropy; and (4) chemical potential changes upon formation. A thermodynamically stable system is achieved when (2) interfacial tension or free energy is minimized and (3) droplet dispersion entropy is maximized. Thus, the role of cosurfactant in formation of a stable o/w microemulsion is to (a) decrease interfacial tension (2); and (b) modify the microemulsion structure and increase the number of possible configurations (3). Also, the cosurfactant will (c) decrease the rigidity. Generally, an increase in cosurfactant concentration results in a wider temperature range of the stability of the product.

The highly suitable cosurfactants of the instant composition over temperature ranges extending from 4° C. to 43° C. are water-soluble $C_2$–$C_4$ alkanols, polypropylene glycol of the formula $HO(CH_3CHCH_2O)_nH$ wherein n is a number from 1 to 18 and monoalkyl ethers and esters of ethylene glycol and propylene glycol having the structural formulas $R(X)_nOH$ and $R_1(X)_nOH$ wherein R is $C_1$–$C_6$ alkyl, $R_1$ is $C_2$–$C_4$ acyl group, X is $(OCH_2CH_2)$ or $(OCH_2CHCH_3)$ and n is a number from 1 to 4.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, propylene glycol tertiary butyl ether, ethylene glycol monoacetate and dipropylene glycol propionate.

While all of the aforementioned glycol ether compounds provide the described stability, the most preferred cosurfactant compounds of each type, on the basis of cost and cosmetic appearance (particularly odor), are glycerol, dipropylene glycol monomethyl ether and propylene glycol. Less preferred cosurfactants are ethanol, propanol, isopropanol, butanol, isobutanol and alkanols having 5 to 7 carbon atoms.

The amount of cosurfactant required to stabilize the microemulsion compositions will, of course, depend on such factors as the surface tension characteristics of the cosurfactant, the type and amounts of the primary surfactants and perfumes, and the type and amounts of any other additional ingredients which may be present in the composition and which have an influence on the thermodynamic factors enumerated above. Generally, amounts of surface from in the range of from 1% to 25%, preferably from about 1% to 15%, especially preferably from about 2% to 8%, by weight provide stable dilute o/w microemulsions for the above-described levels of primary surfactants and perfume and any other additional ingredients as described below.

The essential ingredients discussed above can be solubilized in one preferred embodiment of the invention in water and either an alkyl monoethanol amide such as $C_{12}$–$C_{14}$ alkyl monoethanol amide (LMMEA) at a concentration of 0.5 to 5wt. % and/or an alkyl diethanol amides such as coco diethanol amide (CDEA) or lauryl diethanol amide (LDEA) at a concentration of 0.5 to 5 wt. %, preferably 0.5 wt. % to 3 wt. % and mixtures thereof. The instant formulas can contain both alkyl monoethanol amide and alkyl diethanol amide. The solubilizing ingredient can also include 0 to 5 wt. %, preferably 0.1 wt. % to 3 wt. % of at least one water soluble salt of a $C_1$–$C_3$ substituted benzene sulfonate hydrotrope such as sodium xylene sulfonate or sodium cumene sulfonate or a mixture of said sulfonates. Inorganic alkali metal or alkaline earth metal salts such as sodium sulfate, magnesium sulfate, sodium chloride and sodium citrate can be added to the microemulsion at concentrations of 0.5 to 4.0 wt. %. Other ingredients which have been added to the compositions at concentrations of about 0.1 to 4.0 wt. percent are perfumes, preservatives, color stabilizers, sodium bisulfite, ETDA, HETDA and proteins such as lexine protein.

In addition to the previously mentioned essential and optional constituents of the light duty liquid microemulsion detergent, one may also employ normal and conventional adjuvants, provided they do not adversely affect the properties of the detergent. Thus, there may be used various coloring agents and perfumes; sequestering agents such as ethylene diamine tetraacetates; magnesium sulfate heptahydrate; pearlescing agents and opacifiers; pH modifiers; etc. The proportion of such adjuvant materials, in total will normally not exceed 15% of weight of the detergent composition, and the percentages of most of such individual components will be about 0.1 to 5% by weight and preferably less than about 2% by weight. Sodium bisulfite can be used as a color stabilizer at a concentration of about 0.01 to 0.2 wt. %. Typical preservatives are dibromodicyanobutane, citric acid, benzylic alcohol and poly (hexamethylene-biguamide) hydrochloride and mixtures thereof.

The instant compositions can contain about 0.5 to about 10 wt. %, more preferably 1 wt. % to 5 wt. % of an alkyl polysaccharide surfactant. The alkyl polysaccharides surfactants, which are used in conjunction with the aforementioned surfactant have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4- positions rather than at the 1-position, (thus giving e.g. a glucosyl or galactosyl as opposed to a glucoside or galactoside). However, attachment through the 1- position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention.

Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$RO(C_nH_{2n}O)_r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol (ROH) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol (ROH) to displace the short chain alcohol and obtain the desired alkyl polyglucoside. If this two step procedure is used, the short chain alkylglucoside content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, Pa. APG25 is a nonionic alkyl polyglycoside characterized by the formula:

$$C_nH_{2n+1}O(C_6H_{10}O_5)_xH$$

wherein n=10 (2%); n=12 (65%); n=14 (21–28%); n=16 (4–8%) and n=18 (0.5%) and x (degree of polymerization)= 1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C. 21 spindle, 5–10 RPM of 3,000 to 7,000 cps.

The final essential ingredient in the inventive light duty liquid microemulsion compositions having improved interfacial tension properties is water. The proportion of water in the microemulsion compositions generally is in the range of 20% to 97%, preferably 70% to 97% by weight of the usual diluted o/w microemulsion composition.

As believed to have been made clear from the foregoing description, the light duty liquid microemulsion compositions of this invention are especially effective when used as is, that is, without further dilution in water, since the properties of the composition as a microemulsion are best manifested in the neat (undiluted) form. However, at the same time it should be understood that depending on the levels of surfactants, cosurfactants, perfume and other ingredients, some degree of dilution without disrupting the microemulsion, per se, is possible. For example, at the preferred low levels of active surfactant compounds dilutions up to about 50% will generally be well tolerated without causing phase separation, that is, the microemulsion state will be maintained.

However, even when diluted to a great extent, such as a 2- to 10-fold or more dilution, for example, the resulting compositions are still effective in cleaning greasy, oily and other types of soil. Furthermore, the presence of magnesium ions or other polyvalent ions, e.g., aluminum, as will be described in greater detail below further serves to boost cleaning performance of the primary detergents in dilute usage.

In addition to the above-described essential ingredients required for the formation of the microemulsion composition, the compositions of this invention may possibly contain one or more additional ingredients which serve to improve overall product performance.

One such ingredient is an inorganic or organic salt or oxide of a multivalent metal cation, particularly $Mg^{++}$. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level. Thus, depending on such factors as the the nature of the primary surfactants and cosurfactant, and so on, as well as the availability and cost factors, other suitable polyvalent metal ions include aluminum, copper, nickel, iron, calcium, etc. can be employed. It should be noted, for example, that with the preferred sulfonate anionic detergent calcium salts will precipitate and should not be used. It has also been found that the aluminum salts work best at pH below 5 or when a low level, for example about 1 weight percent, of citric acid is added to the composition which is designed to have a neutral pH. Alternatively, the aluminum salt can be directly added as the citrate in such case. As the salt, the same general classes of anions as mentioned for the magnesium salts can be used, such as halide (e.g., bromide, chloride), sulfate, nitrate, hydroxide, oxide, acetate, propionate, etc.

Preferably, in the dilute compositions the metal compound is added to the composition in an amount sufficient to provide at least a stoichiometric equivalent between the anionic surfactant and the multivalent metal cation. For example, for each gram-ion of Mg++ there will be 2 gram moles of paraffin sulfonate, alkylbenzene sulfonate, etc., while for each gram-ion of $A1^{3+}$ there will be 3 gram moles of anionic surfactant. Thus, the proportion of the multivalent salt generally will be selected so that one equivalent of compound will neutralize from 0.1 to 1.5 equivalents, preferably 0.9 to 1.4 equivalents, of the acid form of the anionic detergent. At higher concentrations of anionic detergent, the amount of multivalent salt will be in range of 0.5 to 1 equivalents per equivalent of anionic detergent. The concentration of the magnesium sulfate is 0 to 4%, more preferably 0.1 to 2% by weight.

The light duty liquid microemulsion composition of this invention may, if desired, also contain other components either to provide additional effect or to make the product more attractive to the consumer. The following are mentioned by way of example: Colors or dyes in amounts up to 0.5% by weight; bactericides in amounts up to 1% by weight; preservatives or antioxidizing agents, such as formalin, 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed.

Because the compositions as prepared are aqueous liquid formulations and since no particular mixing is required to form the o/w microemulsion, the compositions are easily prepared simply by combining all the ingredients in a suitable vessel or container. The order of mixing the ingredients is not particularly important and generally the various ingredients can be added sequentially or all at once or in the form of aqueous solutions of each or all of the primary detergents and cosurfactants can be separately prepared and combined with each other and with the perfume. The magnesium salt, or other multivalent metal compound, when present, can be added as an aqueous solution thereof or can be added directly. It is not necessary to use elevated temperatures in the formation step and room temperature is sufficient.

In final form, the instant microemulsion compositions exhibit stability at reduced and increased temperatures. More specifically, such compositions remain clear and stable in the range of 5° C. to 5° C., especially 10° C. to 43° C. The instant compositions have a light transmission of at least 95%. Such compositions exhibit a pH of 5 to 8. The liquid compositions are readily pourable and exhibit a viscosity in the range of 100 to 400 cps as measured at 25° C. with a Brookfield RVT Viscometer using a #2 spindle rotating at 30 rpm. Preferably, the viscosity is maintained in the range of 150 to 300 cps. The instant compositions have a minimum foam height of 150 mls after 55 rotation at 40° C. as measured by the foam volume test using 0.75 grams of the composition per liter of water and 10 grams of corn oil per liter of water having a hardness of 300 ppm.

The following examples illustrate liquid cleaning compositions of the described invention. Unless otherwise specified, all percentages are by weight. The exemplified compositions are illustrative only and do not limit the scope of the invention.

EXAMPLE 1

The following compositions in wt. % were prepared by the previously described process:

| | A | B | C | D | E |
|---|---|---|---|---|---|
| Mg $(LAS)_2$ ($C_{10-16}$ linear alkyl benzene sulfonate) | 20 | 24 | 4 | 30 | 24 |
| $NH_4$AEOS1.3EO | 12 | 8 | 30 | 4 | 8 |
| LMMEA | 2 | 2 | 0 | 0 | 2 |
| D-Limonene | 4 | 4 | 4 | 4 | 0 |
| Dipropylene glycol monomethyl ether | 4 | 4 | 4 | 4 | 0 |
| APG 625 | 0 | 0 | 0 | 0 | 2 |
| Sodium cumene sulfonate | 1. | 1 | 1 | 1 | 0 |
| Sodium xylene sulfonate | 1.2 | 1.2 | 0 | 0 | 1.2 |
| Water | Bal. | Bal. | Bal. | Bal. | Bal. |
| pH | 7 | 7 | 7 | 7 | 7 |
| Light transmission % | 98 | 98 | 98 | 98 | 98 |
| Initial shake foam | 383 | 295 | 348 | 258 | 304 |
| Shake foam with sod | 183 | 11 | 17 | 78 | 168 |
| Miniplate | 36 | 40 | 33 | 42 | 45 |
| Lard removal | 37 | 50 | 0 | 44 | 76 |
| Shell foam ratio | 82 | 88 | 80 | 64 | 96 |
| Gardner Strokes Neat | 8 | 9 | 10 | 8 | >14 |

| | F | G | H | I | J |
|---|---|---|---|---|---|
| Mg $(LAS)_2$ ($C_{10-16}$ linear alkyl benzene sulfonate) | 24 | 24 | 24 | 24 | 24 |
| $NH_4$AEOS1.3EO | 8 | 8 | 8 | 8 | 8 |
| LMMEA | 2 | 2 | 2 | 2 | 2 |
| D-Limonene | 0 | 2 | 4 | 6 | 8 |
| Dipropylene glycol monomethyl ether | 0 | 2 | 4 | 6 | 8 |
| APG 625 | 0 | 0 | 0 | 0 | 0 |
| Sodium cumene sulfonate | 0 | 0 | 0 | 0 | 0 |
| Sodium xylene sulfonate | 1.2 | 1.2 | 1.2 | 1.2 | 1.2 |
| Water | Bal. | Bal. | Bal. | Bal. | Bal. |
| pH | 7 | 7 | 7 | 7 | 7 |
| Light transmission % | 98 | 98 | 98 | 98 | 98 |
| Initial shake foam | 310 | 305 | 313 | 312 | 307 |
| Shake foam with soil | 192 | 174 | 195 | 162 | 171 |
| Miniplate | 46 | 46 | 44 | 45 | 43 |
| Lard removal | 65 | 69 | 60 | 68 | — |
| SheIl foam ratio | 80 | 90 | 77 | 82 | 77 |
| Gardner Strokes Neat | >14 | 12 | 7 | 5 | — |

| | K | L | M | Dawn | Palmolive |
|---|---|---|---|---|---|
| Mg $(LAS)_2$ ($C_{10-16}$ linear alkyl benzene sulfonate) | 24 | 24 | 24 | | |
| $NH_4$AEOS1.3EO | 8 | 8 | 8 | | |
| LMMEA | 2 | 2 | 2 | | |
| D-Limonene | 10 | 4 | 6 | | |
| Dipropylene glyool monomethyl ether | 10 | 4 | 6 | | |
| APG 625 | 0 | 1.5 | 1.5 | | |
| Sodium cumene sulfonate | 0 | 1 | 1 | | |
| Sodium xylene sulfonate | 1.2 | 1.2 | 1.2 | | |
| Water | Bal. | Bal. | Bal. | | |
| pH | 7 | 7 | 7 | 6.5 | 7 |
| Light transmission % | 98 | 98 | 98 | | |
| Initial shake foam | 295 | 265 | 260 | 327 | 328 |
| Shake foam with soil | 187 | 120 | 107 | 218 | 140 |
| Miniplate | 46 | 45 | 46 | 49 | 35 |
| Lard removal | — | 49 | 51 | 40 | 46 |
| Shell foam ratio | 84 | 89 | 89 | 154 | 100 |
| Gardner Strokes Neat | — | 9 | 6 | 14 | >14 |

In summary, the described invention broadly relates to an improvement in a light duty liquid microemulsion composition containing a mixture of a paraffin sulfonate surfactant and an alkyl polyethenoxy ether sulfate surfactant, a biodegradable surfactant, one of the specified cosurfactants, a hydrocarbon ingredient and water to form a light duty liquid microemulsion composition.

What Is claimed:

1. A light duty liquid microemulsion cleaning composition comprising approximately by weight: 15% to 36% of a magnesium salt of an alkyl benzene sulfonate surfactant, 1% to 20% of a metal or ammonium salt of an alkyl ether polyethenoxy sulfate surfactant; 1% to 5% of an alkyl polyglucoside; 0.5% to 5% of an alkyl monoalkanol amide, 0.4% to 10.0% of a water insoluble hydrocarbon, essential oil or perfume; 1 to 25% of a water soluble glycol ether cosurfactant, and 20% to 97% of water, wherein the composition does not contain a $C_{12-16}$ mono olefin sulfonate or a grease release agent consisting of

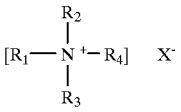

wherein $R_1$ is a methyl group and $R_2$, $R_3$ and $R_4$ are independently selected from the group consisting of $CH_3$, $C_2H_5$, $CH_2CH_2Y$, wherein Y is selected from the group consisting of Cl, Br, $CO_2H$, $(CH_2O)_nOH$, wherein n is 1 to 10 and OH and X is selected from the group consisting of Cl, Br, methosulfate and $HCO_3$ -.

2. A light duty liquid microemulsion composition according to claim 1, wherein said sulfonate and said alkyl ether polyethenoxy sulfate are in a ratio of about 8:1 to about 1:8.

3. The cleaning composition of claim 2 which further contains a salt of a multivalent metal cation in an amount sufficient to provide from 0.5 to 1.5 equivalents of said cation per equivalent of said sulfonate detergent.

4. The cleaning composition of claim 3 wherein the multivalent metal cation is magnesium or aluminum.

5. The cleaning composition of claim 3, wherein said composition contains 0.9 to 1.4 equivalents of said cation per equivalent of said sulfonate detergent.

6. The cleaning composition of claim 4 wherein said multivalent salt is magnesium sulfate.

7. The cleaning composition of claim 2 which contains from about 2 to 8% by weight of said cosurfactant and from about 2.0% to about 7.0% by weight of said hydrocarbon.

8. The cleaning composition of claim 1 wherein the glycol ether is selected from the group consisting of ethylene glycol monobutylether, diethylene glycol monobutyl ether, triethylene glycol monobutylether, and propylene glycol tert-butyl ether and mono-, di-, tri-propylene glycol monobutyl ether and mixtures thereof.

9. The cleaning composition of claim 8 wherein the glycol ether is dipropylene glycol monomethyl ether.

10. The cleaning composition of claim 2 wherein the sulfonate surfactant is a $C_9$–$C_{15}$ alkyl benzene sulfonate or a $C_{13-17}$ paraffin sulfonate.

11. The cleaning composition of claim 10, wherein said metal of said metal salt of said alkyl ether polyethenoxy sulfate is selected from the group consisting of potassium and sodium.

* * * * *